US010368605B2

(12) United States Patent
Handfield et al.

(10) Patent No.: US 10,368,605 B2
(45) Date of Patent: Aug. 6, 2019

(54) SUPPORT AND ATTACHMENT SYSTEM FOR HELMET GOGGLES

(71) Applicant: Kimpex Inc., Drummondville, Quebec (CA)

(72) Inventors: Robert Handfield, St-Lucien (CA); Nicolas Bouchard-Fortin, Racine (CA)

(73) Assignee: KIMPEX, INC., Drummondville (CA)

( * ) Notice: Subject to any disclaimer, the term of this patent is extended or adjusted under 35 U.S.C. 154(b) by 183 days.

(21) Appl. No.: 15/415,596

(22) Filed: Jan. 25, 2017

(65) Prior Publication Data

US 2018/0206582 A1 Jul. 26, 2018

(51) Int. Cl.
*A42B 3/18* (2006.01)

(52) U.S. Cl.
CPC ..... *A42B 3/185* (2013.01)

(58) Field of Classification Search
CPC ..... A42B 3/185
See application file for complete search history.

(56) References Cited

U.S. PATENT DOCUMENTS

| | | | | |
|---|---|---|---|---|
| 4,686,712 | A * | 8/1987 | Spiva | A42B 3/185 2/10 |
| 4,918,753 | A * | 4/1990 | Mermillod | A42B 3/185 2/10 |
| 6,845,548 | B1 * | 1/2005 | Lin | A42B 3/185 2/10 |
| 2012/0180202 | A1 * | 7/2012 | McNeal | A42B 3/185 2/422 |
| 2012/0180203 | A1 * | 7/2012 | Giroux | A42B 3/185 2/422 |

* cited by examiner

*Primary Examiner* — Robert Sandy
(74) *Attorney, Agent, or Firm* — Brouillette Legal Inc.; Robert Brouillette

(57) ABSTRACT

A support and attachment system for helmet goggles is described. The main purposes of such a system are to provide an easy attaching of goggles to a helmet and to block the sliding movement of goggles over the outside surface of a helmet by a sliding stop. The support and attachment system for helmet goggles includes two strap connectors each being configured to be attached, on each respective side of the helmet, to the free ends of the goggles' straps and to engage, two attachment supports disposed on the opposite sides of a helmet. One of the strap connectors is adapted to be easily removable while the second is configured to be somewhat difficult to remove. The attachment support connected to the second strap connector includes a sliding stop to block the sliding movement of the goggles when positioned on the top of the outside surface of the helmet.

17 Claims, 12 Drawing Sheets

SUPPORT AND ATTACHMENT SYSTEM FOR HELMET GOGGLES

CROSS-REFERENCE TO RELATED APPLICATIONS

There are no cross-related applications.

FIELD OF THE INVENTION

The present invention generally relates to a support and attachment system for helmet goggles. More specifically, the present invention relates at once to a system to attach goggles to a helmet and to prevent goggles from sliding over the outside surface of the helmet.

BACKGROUND OF THE INVENTION

Nowadays, a plurality of systems exist to attach goggles to a helmet. They aim to provide an easy and secure mounting of the goggles to the helmet while remaining easily removable. Such systems allow a rapid adjustment and placement of the goggles when worn by a user. However, once one side is detached, the goggles hang on the side of the helmet which is not that comfortable for the user and also exposes the goggles to it different possible objects.

Different systems exist to attach goggles to a helmet, such as the attachment system disclosed in the U.S. Pat. No. 9,072,331 where it has been proposed to provide a pivotal attachment of the goggles to the helmet allowing the goggles to rotate to various positions on the outside surface of the helmet. While such a system comprises structural elements to prevent the detachment of the goggles from the helmet, it does not prevent the goggles from sliding over the outside surface of the helmet and becoming difficult to reach.

Furthermore, conventional helmet goggle attachment systems are designed in such a way that the strap of the goggles on only one side is easily disconnectable, while the strap on the other side is pivoted to the helmet and remains connected. In fact, many of these systems are made such that the removable side of the goggles' strap is attached to the helmet by means of mating sections of Velcro® hook and loop fasteners. Such an attachment system can be easily defeated after a daily use especially in bad weather conditions or dirty environment.

SUMMARY OF THE INVENTION

The aforesaid and other objectives of the present invention are realized by generally providing a system for supporting and attaching goggles to a helmet.

The system according to the present invention aims to provide a secure attachment of goggles to a helmet while ensuring a long-term use thanks to a mechanical gripping system. Contrary to Velcro® hook and loop fasteners, the daily use of the support and attachment system according to the present invention is not affected by weather conditions or environmental conditions.

In another aspect of the invention, the use of a mechanical gripping system to attach goggles to a helmet according to the present invention ensures an easy and secure removing and wearing of goggles and a better long-term use than Velcro® hook and loop fasteners.

Moreover, the support and attachment system for helmet goggles according to the present invention aims to provide a better protection for goggles when they are not in use by the user. In fact, the present invention provides a possibility to keep goggles on the top of the outside surface of a helmet with limited risk related to a possible sliding of the goggles over the concerned surface thanks to the use of a sliding stop.

Furthermore, the possibility of keeping goggles on the top of the outside surface of a helmet when they are unused by the user, prevents the goggles from any possible defects related to the fact that goggles usually remain hanging on the side of the helmet.

The support and attachment system for helmet goggles according to the present invention comprises a first goggle strap connector adapted to engage an at least one first protrusion of a first attachment support that is attached to a helmet's side. The first goggle strap connector is adapted to be easily removable from the first attachment support. The support and attachment system further comprises a second goggle strap connector adapted to engage an at least one second protrusion of a second attachment support that is attached to the other side of the helmet. The second goggle strap connector is configured to be somewhat difficult to remove from the second attachment support. The second attachment support is provided with a stop protrusion offering a possibility to keep the goggles resting on the top of the outside surface of the helmet without sliding completely over this surface.

The present invention also provides a method for attaching helmet goggles to an helmet. The method comprises first attaching a first attachment support to a side of the helmet and attaching a second attachment support to the other side of the helmet. The method further comprise engaging a second goggle strap connector with a second protrusion of the second attachment support and engaging a first goggle strap connector with a first protrusion of the first attachment support.

The method for attaching helmet goggles to an helmet may further comprise engaging a side of the second goggle strap connector inside a stop protrusion of the second attachment support in a way to block the rearward rotation of the second goggle strap connector and the rearward sliding movement of the goggles over the outside surface of the helmet.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

Figure 1:
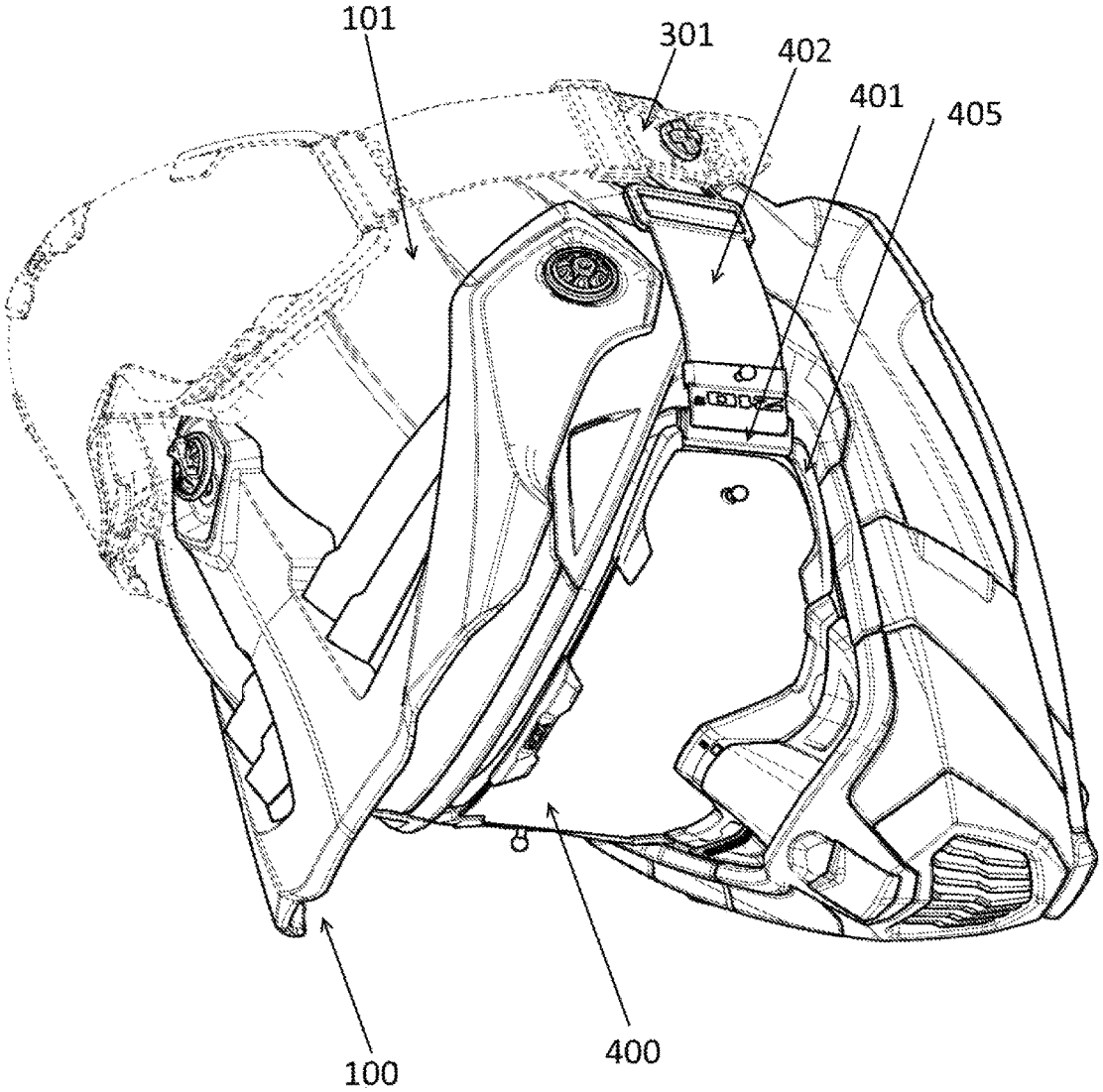
FIG. 1 is a perspective view of a helmet showing the removable side of a support and attachment system for helmet goggles in accordance with the principles of the present invention.
Figure 2:
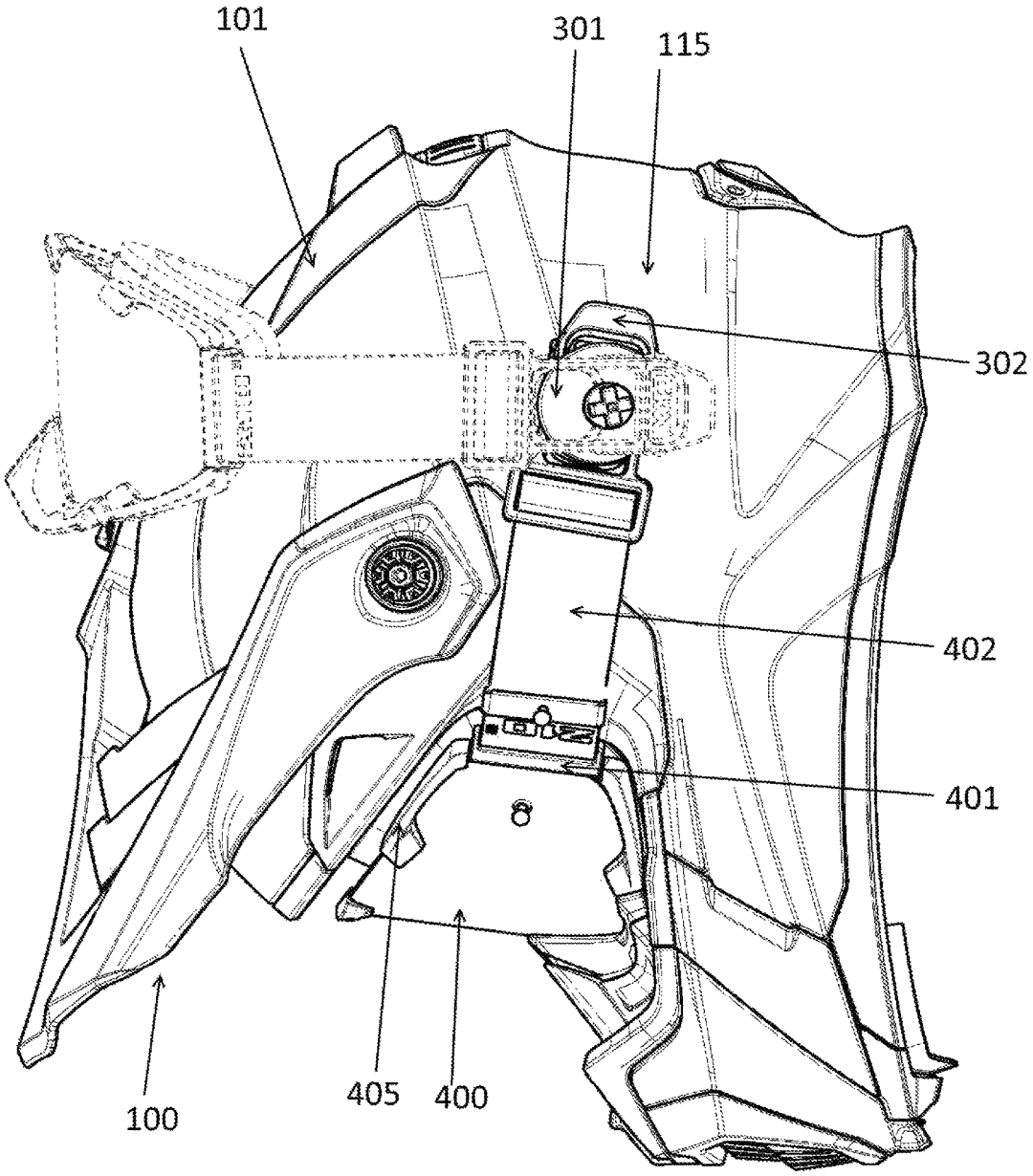
FIG. 2 is a side view of the helmet of FIG. 1 showing the removable side of a support and attachment system for helmet goggles in accordance with the principles of the present invention.

A novel support and attachment system for helmet goggles will be described hereinafter. Although the invention is described in terms of specific illustrative embodiments, it is to be understood that the embodiments described herein are by way of example only and that the scope of the invention is not intended to be limited thereby.

FIGS. 1 to 4 illustrate a preferred embodiment of a support and attachment system for goggles 400 to a helmet 100. Goggles 400 have a frame 405 that is attached in both sides to resilient straps 402 and 404 by the mean of two connectors 401 and 403. The free ends of the resilient straps 402 and 404 are each adapted to receive an attachment mean, referred herein after as a goggle strap connector. Thus, the end of the first resilient strap 402 is attached to a first goggle strap connector 302 configured to be easily removable from a helmet's first attachment support 301 while the end of the second resilient strap 404 is attached to a second goggle strap connector 202 configured to be somewhat difficult to remove from a helmet's second attachment support 201.

In a preferred embodiment, the first and the second attachment supports 301 and 201 are positioned on opposite sides of the helmet 100.

Figure 3:
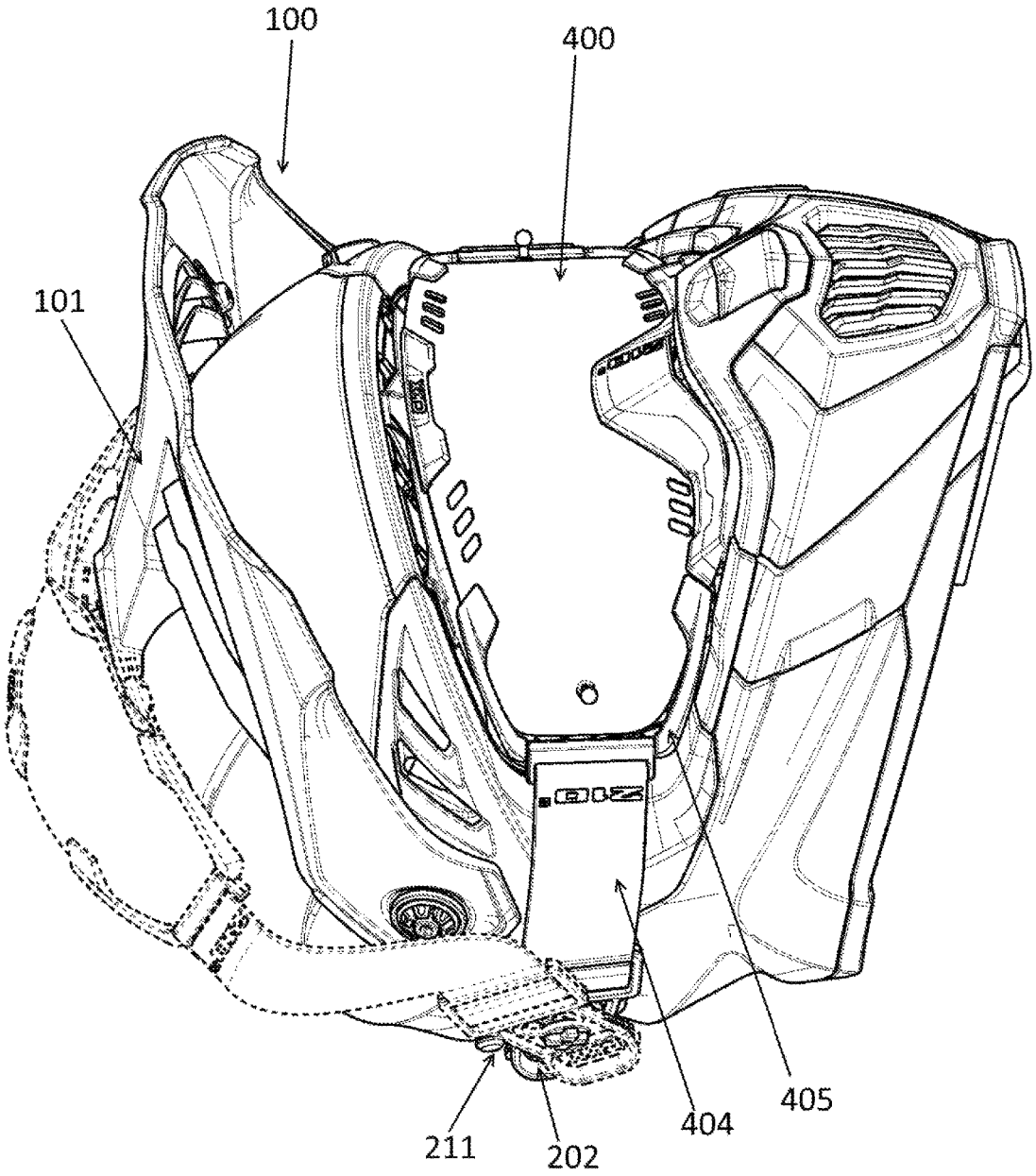
FIG. 3 is a perspective view of the helmet of FIG. 1 showing the somewhat difficult to remove side of a support and attachment system for helmet goggles having a stop in accordance with the principles of the present invention.
Figure 4:
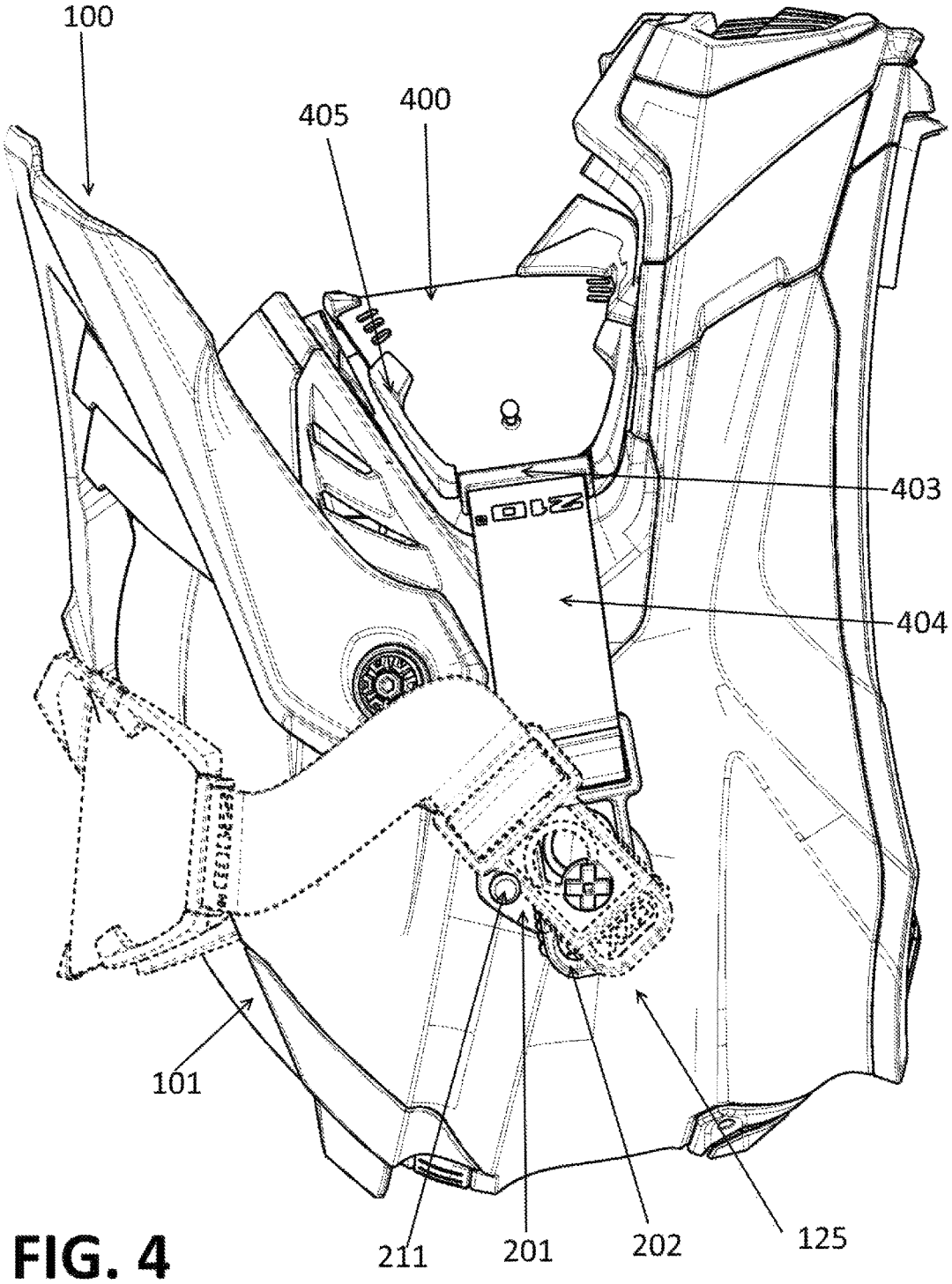
FIG. 4 is a side view of the helmet of FIG. 1 showing the somewhat difficult to remove side of a support and attachment system for helmet goggles having a stop in accordance with the principles of the present invention.
Figure 7:
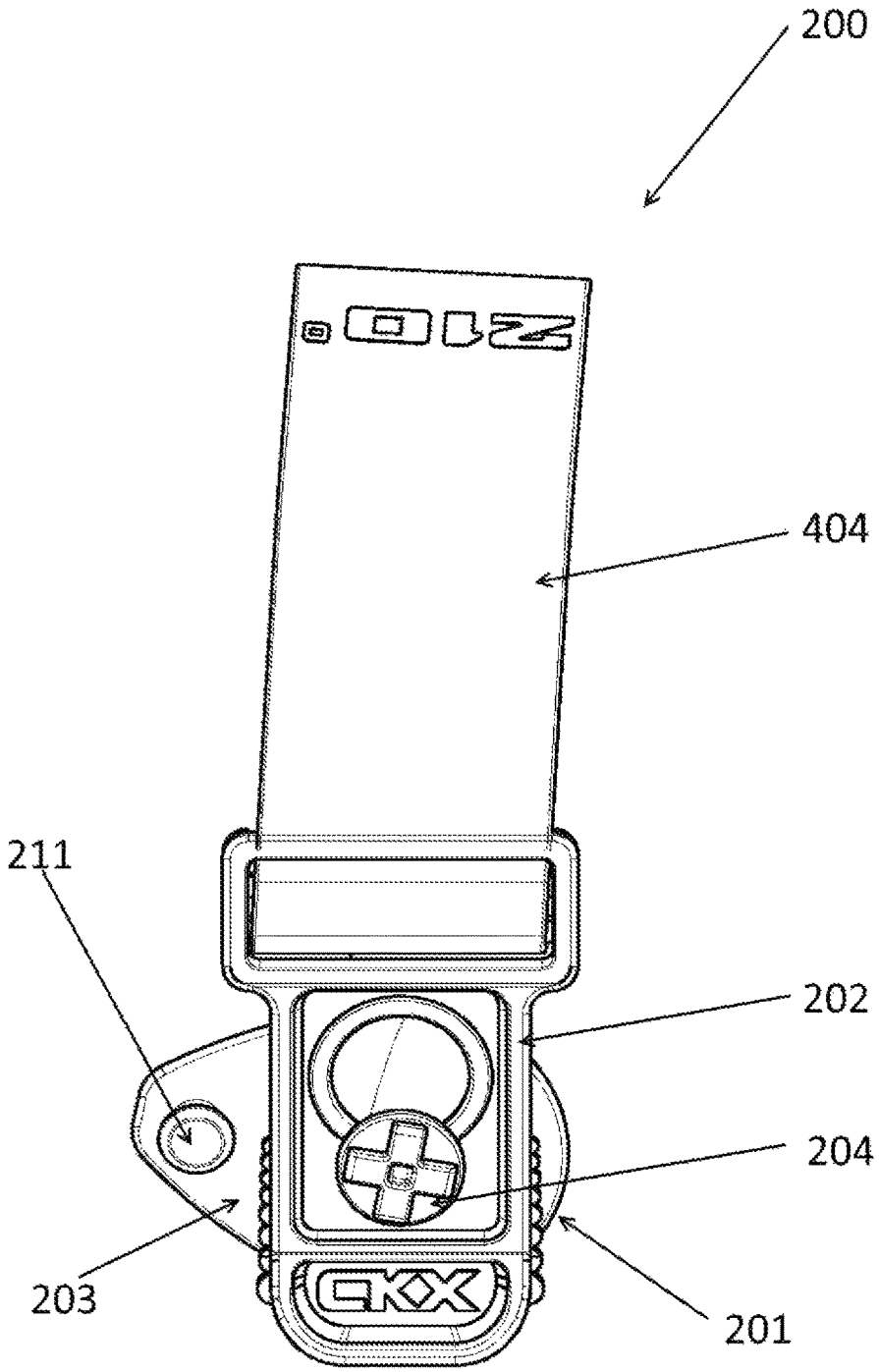
FIG. 7 is a front view of the somewhat difficult to remove side of a support and attachment system (with a partial strap) for helmet goggles having a stop in accordance with the principles of the present invention.

Referring now to FIGS. 3, 4 and 7, in a preferred embodiment, the somewhat difficult to remove side 200 of the support and attachment system for helmet goggles is further adapted to prevent goggles 400 from sliding over the back of the outside surface 101 of the helmet 100 by the mean of a first protrusion 211, referred herein after as a stop, extending upwardly from the upper surface 203 of the second attachment support 201.

Figure 5:
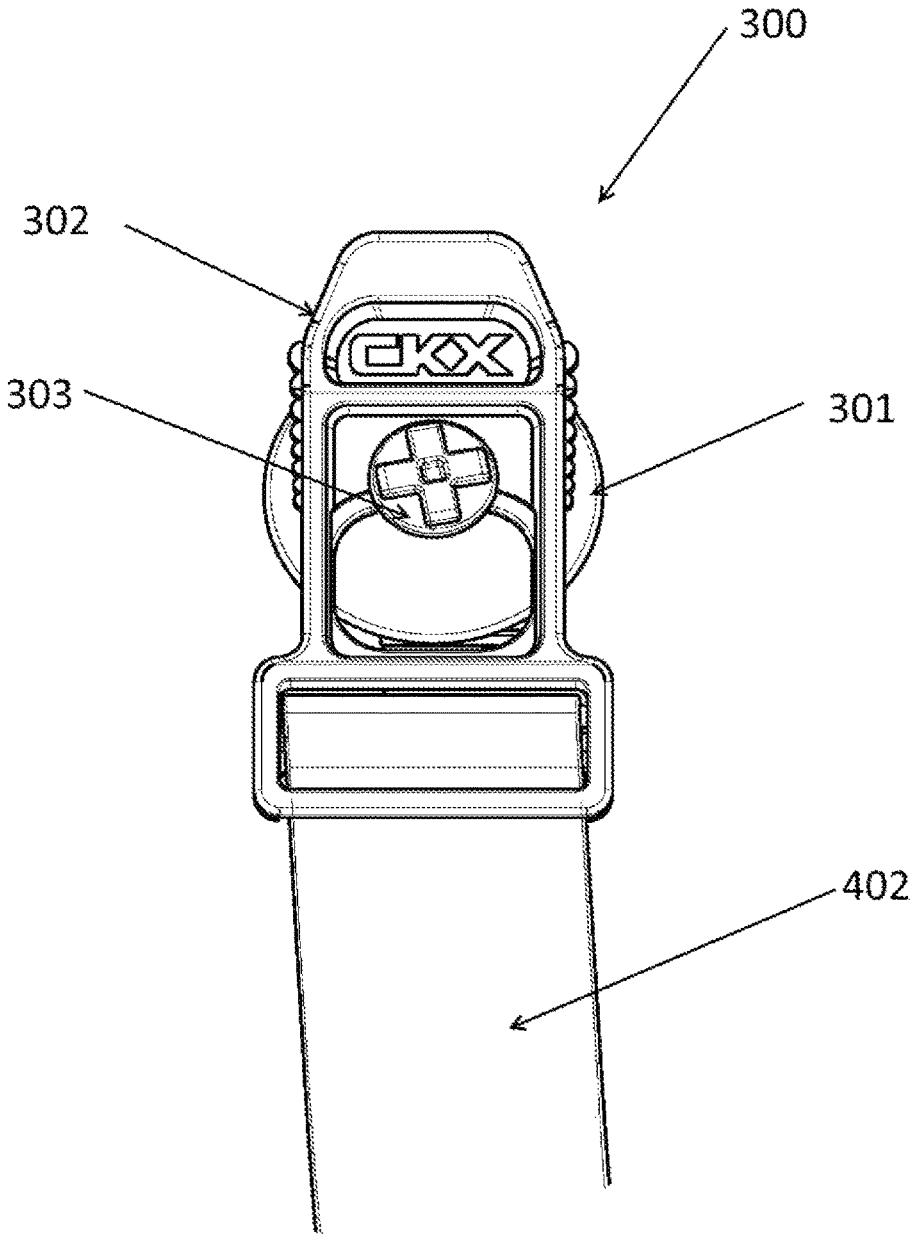
FIG. 5 is a front view of the removable side of a support and attachment system (with a partial strap) for helmet goggles in accordance with the principles of the present invention.

Referring now to FIGS. 5 and 7, both sides of a preferred embodiment of a support and attachment system for helmet goggles are illustrated as front views. Thus, FIG. 5 shows a side of a support and attachment system 300 that is configured to be easily removable while FIG. 7 shows a side of a support and attachment system 200 that is adapted to be somewhat difficult to remove.

In a preferred embodiment, on the one hand, the easily removable side of a support and attachment system for helmet goggles comprises essentially two major parts: a first attachment support 301 and a first goggle strap connector 302 adapted to engage each other by the mean of a second protrusion 303. On the other hand, the somewhat difficult to remove side 200 of a support and attachment system for helmet goggles comprises a second attachment support 201 and a second goggle strap connector 202 adapted to engage each other by the mean of a third protrusion 204 when the goggles are worn by the user and by the mean of the same protrusion 204 and the stop 211 when goggles are positioned on the top of the outside surface of the helmet.

FIGS. 2, 5, 6, 9 and 10 illustrate various views of a preferred embodiment of a first attachment support 301. The first attachment support 301 has a base 3010 wherein the under face 3011 of the base is attached to one side 115 of the outer surface 101 of the helmet 100. Furthermore, the first attachment support 301 comprises a protrusion 303 extending upwardly from the upper face 3012 of the base 3010. The protrusion 303 comprises two different portions: a first portion 3014 adapted to engage a first opening 3024 of a slot 3020 of the first goggle strap connector 302 and a second portion 3015 having a diameter greater than the diameter of the first portion 3014 and adapted to engage a top portion 3022 of the first goggle strap connector 302. The second portion 3015 is configured to prevent undesirable disconnection of the goggles from the helmet.

In a preferred embodiment, a reinforcement structure 3016 may be formed on the top of the second portion 3015 to provide additional strength to the protrusion 303.

Figure 6:
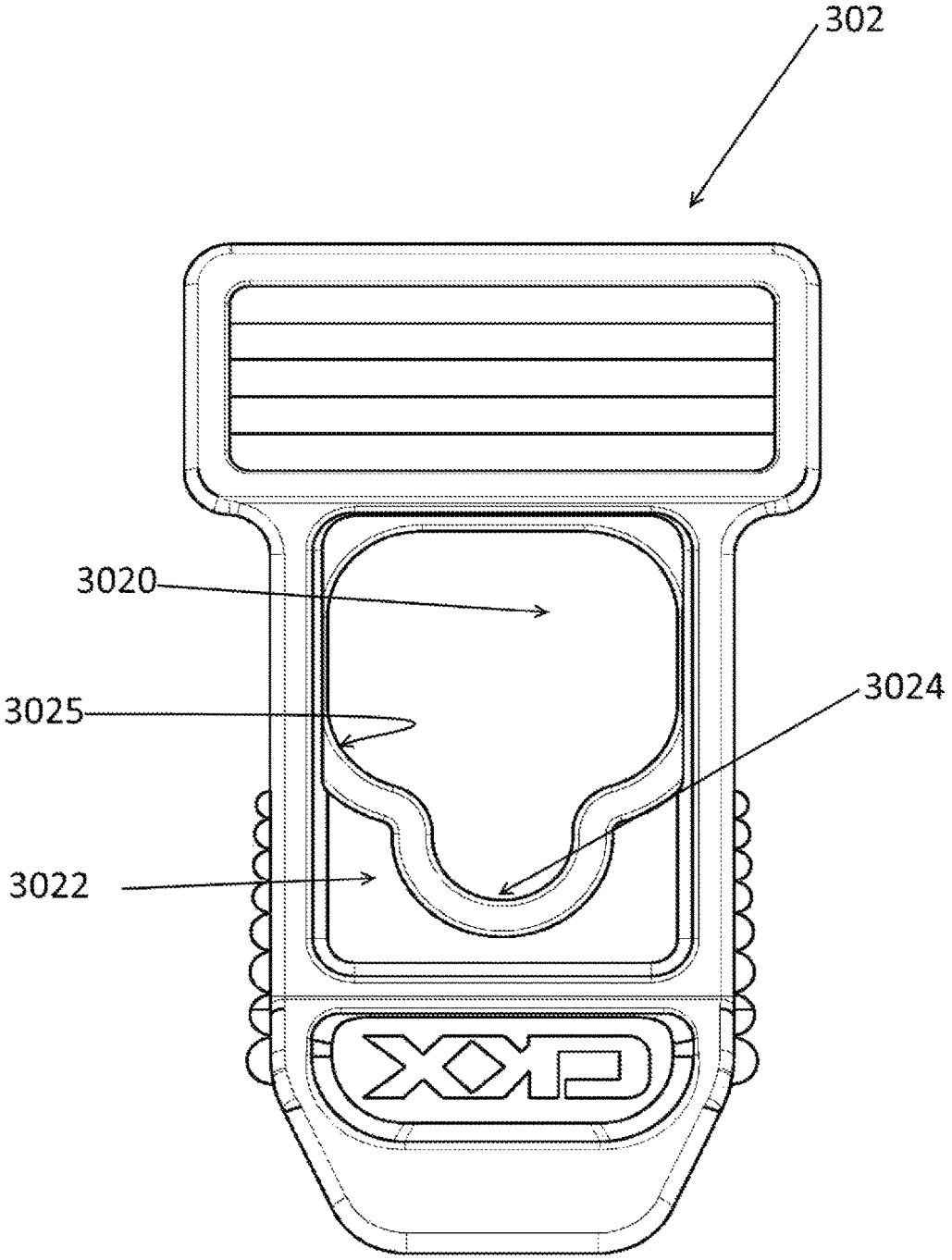
FIG. 6 is a front view of a first strap connector (without the strap) for the removable side of a support and attachment system for helmet goggles in accordance with the principles of the present invention.

In a preferred embodiment and as shown in FIG. 6, the first goggle strap connector 302 comprises a slot 3020 wherein a first circular opening 3024 extends outwardly from a larger second opening 3025. Such a configuration results in the ease of removal of the connector 302 from the side 115 of the helmet as illustrated on FIG. 2.

Figure 11:
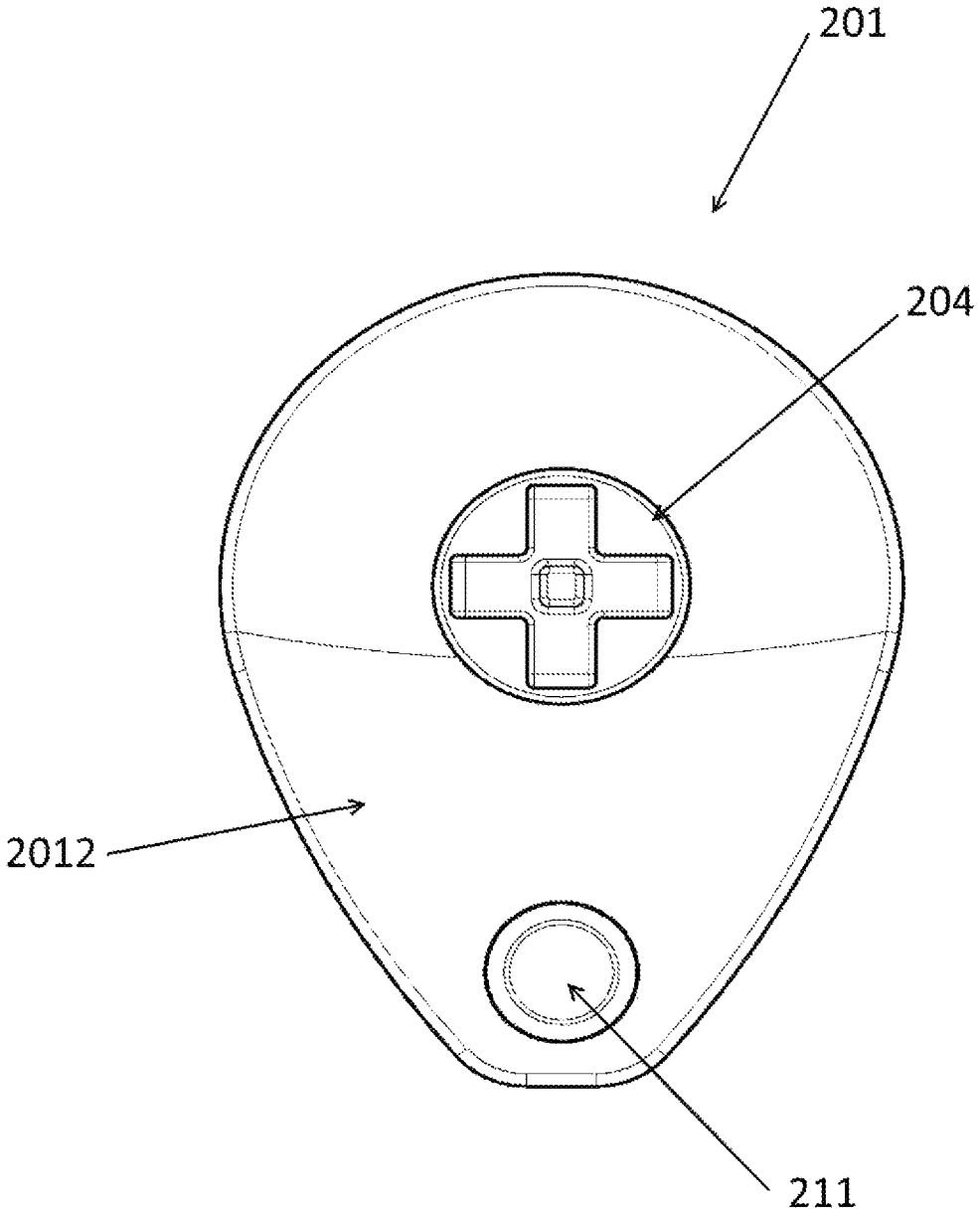
FIG. 11 is a front view of a second attachment support for the somewhat difficult to remove side of a support and attachment system for helmet goggles having a stop in accordance with the principles of the present invention.
Figure 12:
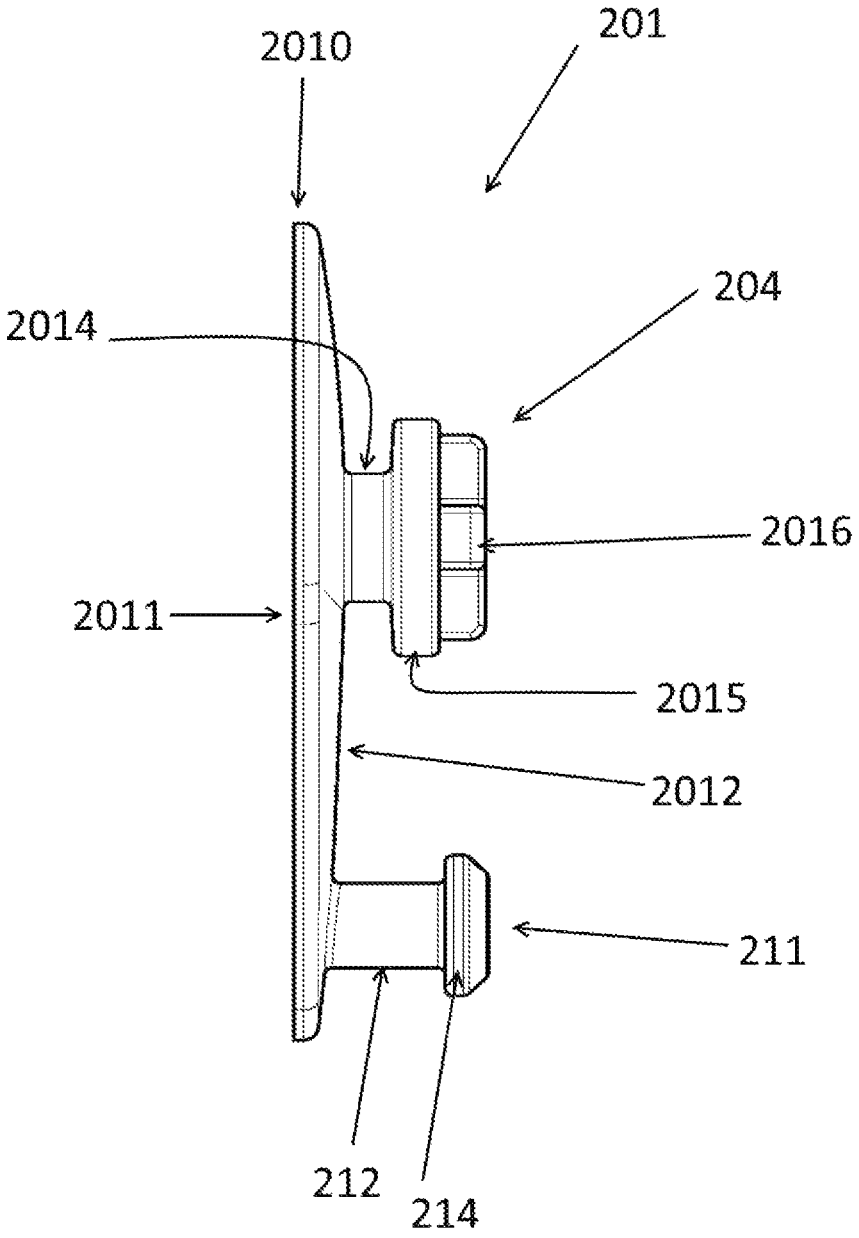
FIG. 12 is a side view of the second attachment support of FIG. 11 in accordance with the principles of the present invention.

Now referring to FIGS. 11 and 12, various views of a preferred embodiment of a second attachment support 201 are illustrated. The second attachment support 201 allows not only the attachment of goggles to the helmet but aims also to prevent, thanks to the stop 211, the goggles from sliding completely over the back of the outer surface of the helmet once they are positioned on the top of the helmet. As shown in FIGS. 11 and 12, the second attachment support 201 has a base 2010 wherein the lower face 2011 of the base 2010 is attached to side 125 of the outer surface 101 of the helmet 100 as shown in FIG. 4. Furthermore, the second attachment support 201 comprises two protrusions: a stop 211 and a third protrusion 204 extending both upwardly from the upper face 2012 of the base 2010

In a preferred embodiment, the stop 211 has two different portions. A first portion 212 adapted to be in contact with a side surface of the second goggle strap connector 202 in order to block the rearward sliding movement of the goggles once positioned on the top of the helmet. A second portion 214 having a diameter greater than the first portion 212 is configured to reinforce the blocking of the rearward sliding of goggles.

Figure 8:
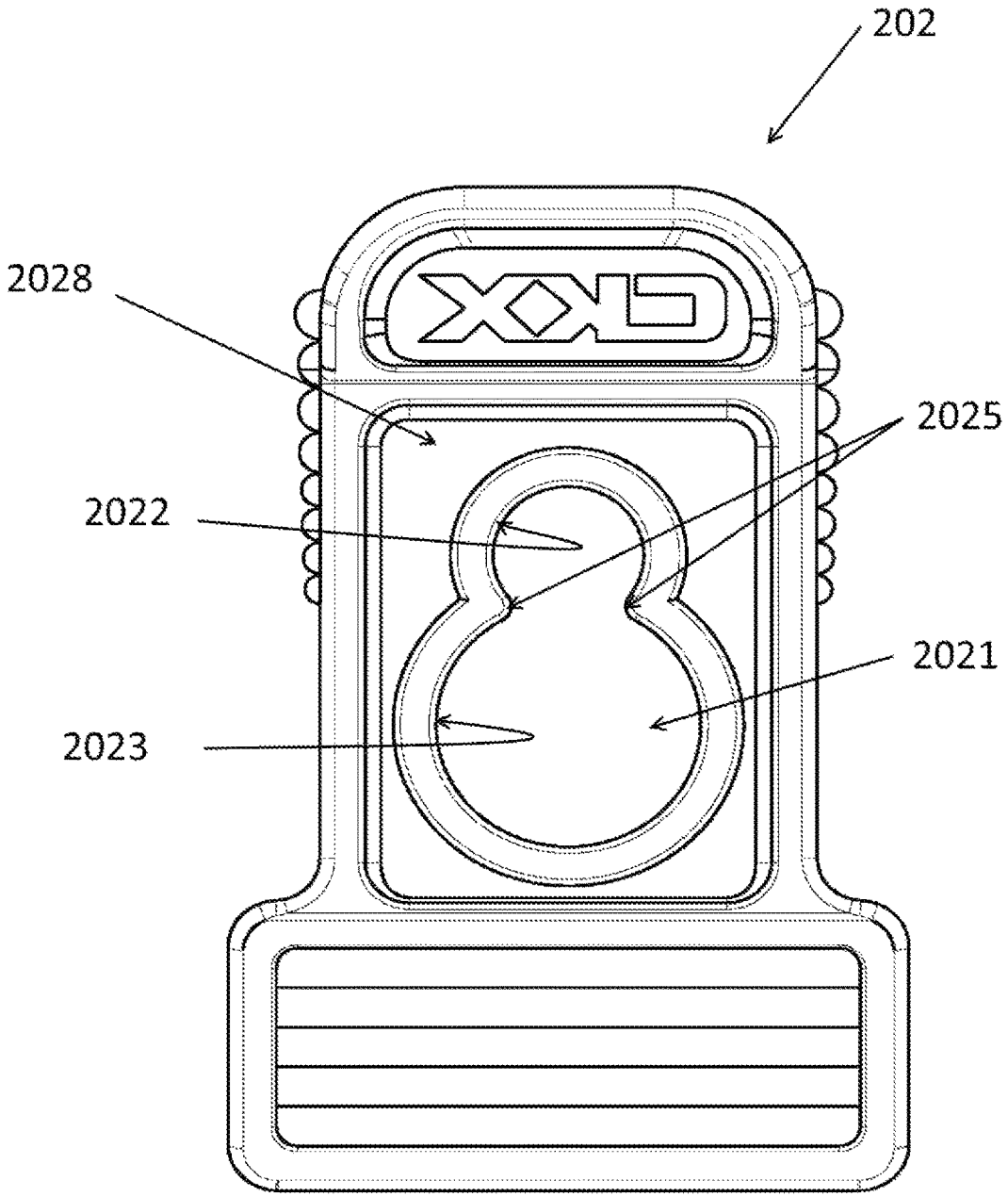
FIG. 8 is a front view of a second strap connector (without the strap) for the somewhat difficult to remove side of a support and attachment system for helmet goggles in accordance with the principles of the present invention.
Figure 9:
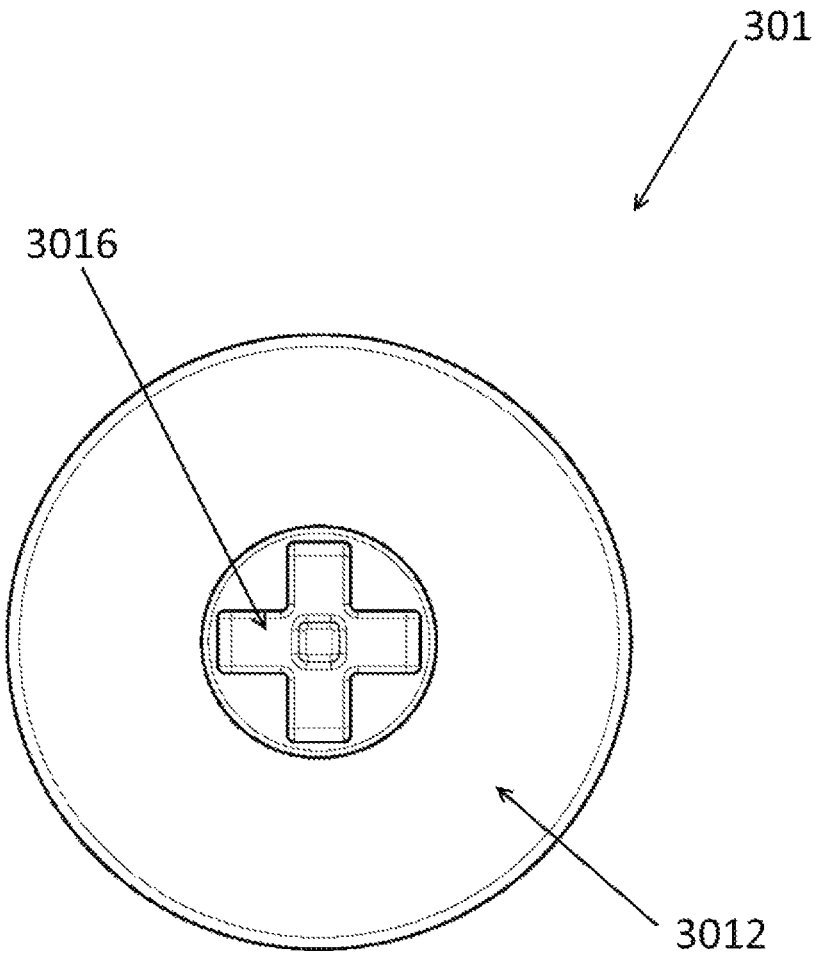
FIG. 9 is a front view of a first attachment support for the removable side of a support and attachment system for helmet goggles in accordance with the principles of the present invention.
Figure 10:
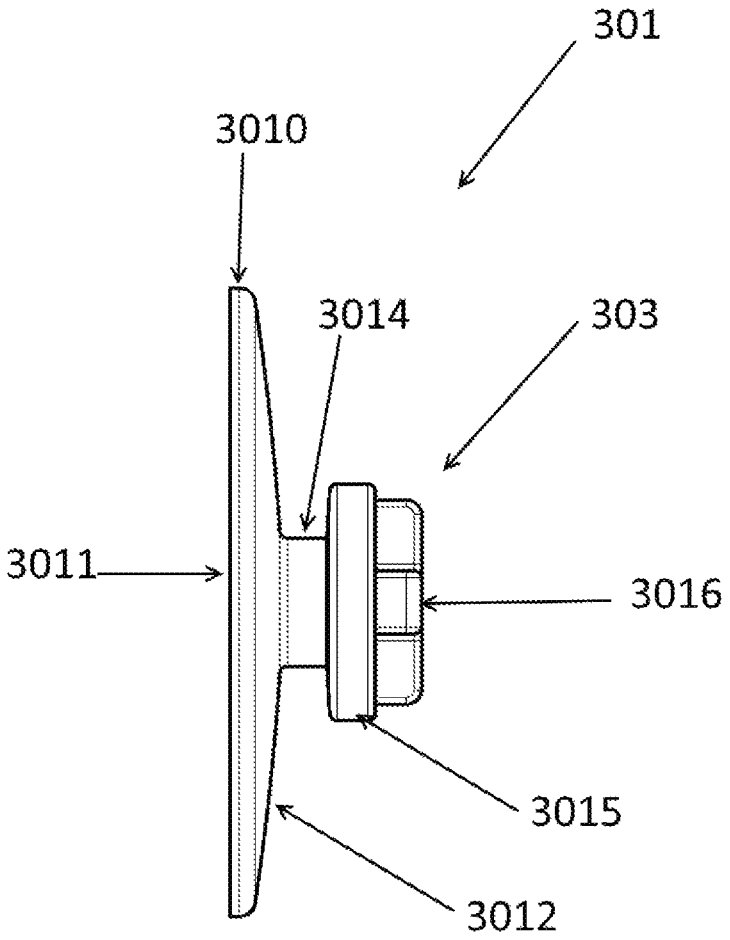
FIG. 10 is a side view of the first attachment support of FIG. 9 in accordance with the principles of the present invention.

Now referring to FIGS. 8 and 12, in a preferred embodiment, the third protrusion 204 has two different portions. A first portion 2014 is adapted to engage a first opening 2022 of a slot 2021 of the second goggle strap connector 202. A second portion 2015 having a diameter greater than the diameter of the first portion 2014 is adapted to engage a top portion 2028 of the second goggle strap connector 202. The second portion 2015 is configured to prevent the undesired disconnection of the goggles from the helmet and is designed in a way to make it somewhat difficult to remove the second goggle strap connector.

In a preferred embodiment, a reinforcement structure 2016 may be formed on the top of the second portion 2015 to provide additional strength to the third protrusion 204.

Now referring to FIG. 8, a preferred embodiment of a second goggle strap connector 202 is illustrated. The second goggle strap connector 202 comprises a slot 2021 that is formed from by first opening 2022 which outwardly extends from a second opening 2023. These two openings 2022 and 2023 join each other with a relatively resilient common cord 2025 which is smaller than the diameter of the first portion 2014 of the second attachment support 201.

In a preferred embodiment, the first and second attachment supports are made of any material offering the desired attachment of the goggles to the helmet and having the desired mechanical strength to block the rearward sliding of the goggles over the back outside surface of the helmet.

In a preferred embodiment, the first and second goggle strap connectors are made of any material offering the desired attachment of the goggles to the helmet Now referring to FIGS. 1 to 12, a method for attaching goggles to a helmet comprises positioning the first attachment support 301 and the second attachment support 201 on opposite sides 115 and 125 of the helmet. The method further comprises engaging the first opening 2022 of the second goggle strap connector 202 with the first portion 2014 of the third protrusion 204 of the second attachment support 201. The engagement between the second attachment support 201 and the second goggle strap connector is made in a way to make it somewhat difficult to remove the goggles. The method for attaching goggles to a helmet comprises engaging the first opening 3024 of the first goggle strap connector 302 with the first portion 3014 of the second protrusion 303 of the first attachment support 301. The engagement between the first attachment support 301 and the first goggle strap connector 302 is made in a way to make it easy to remove the goggles for daily use without risking a damage to the attachment system or a non-expected detachment of the goggles when worn by the user.

The method further comprises positioning the goggles on the outside surface of the helmet when there is no need for them to be worn by the user. In this case, the first goggle strap connector 302 is first detached from the first support 301. Then, the second goggle strap connector is rotated around the first portion 2014 of the third protrusion 204 in a way that a side of the second strap connector 202 rests inside the sliding stop 211 in contact with the first portion 212 of the sliding stop. In this way, the reward rotation movement of the second goggle strap connector (and therefor of the goggles) is blocked.

Finally, the method comprises reattaching back the first goggle strap connector 302 to the first attachment support 301 in a way to make the goggles motionless on the top of the outside surface of the helmet.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A support and attachment system to attach goggles having a pair of holding straps to a helmet, the system comprising:

a first attachment support having at least one first protrusion;

a first goggle strap connector engageable with the at least one first protrusion of the first attachment support;

a second attachment support having at least one second protrusion; and a second goggle strap connector engageable with the at least one second protrusion of the second attachment support;

wherein the second attachment support comprises at least a stop protrusion to block rearward sliding movement of the goggles over the outside surface of the helmet.

2. The support and attachment system of claim 1, wherein the at least one first protrusion of the first attachment support comprises a first grip portion to engage the first goggle strap connector.

3. The support and attachment system of claim 2, wherein the at least one first protrusion of the first attachment support comprises at least a first top portion having a dimension greater than a dimension of the first grip portion to prevent an unintended detachment of the first goggle strap connector.

4. The support and attachment system of claim 3, wherein the at least one first protrusion of the first attachment support comprises at least one reinforcement portion to provide an additional strength to the first top portion.

5. The support and attachment system of claim 2, wherein the first goggle strap connector comprises openings to engage the first grip portion of the at least one first protrusion of the first attachment support and to provide an easy removal of the first goggle strap connector once engaged to the first attachment support.

6. The support and attachment system of claim 5, wherein at the first goggle strap connector comprises at least one opening having the same shape as the first grip portion of the at least one first protrusion of the first attachment support to provide a better engagement between the first goggle strap connector and the first attachment support.

7. The support and attachment system of claim 1, wherein the first goggle strap connector is adapted to be attached to a free end of one of said straps.

8. The support and attachment system of claim 1, wherein the at least one second protrusion of the second attachment support comprises a second grip portion to engage the second goggle strap connector.

9. The support and attachment system of claim 8, wherein the at least one second protrusion of the second attachment support comprises at least a second top portion having a dimension greater than the dimension of the second grip portion to prevent the unintended detachment of the second goggle strap connector.

10. The support and attachment system of claim 9, wherein the at least one second protrusion of the second attachment support comprises at least one reinforcement portion to provide an additional strength to the at least second top portion.

11. The support and attachment system of claim 8, wherein the second goggle strap connector comprises at least one slot comprising a first opening having the same shape as the second grip portion of the at least one second protrusion of the second attachment support; the first opening outwardly extending from a second opening with a common cord; the common cord being smaller than the diameter of the second grip portion of the second attachment support to make it somewhat difficult to remove the second goggle strap connector once engaged to the second attachment support.

12. The support and attachment system of claim 1, wherein the second goggle strap connector is adapted to be attached to a free end of the other said strap.

13. The support and attachment system of claim 1, wherein the second goggle strap connector comprises openings to engage the second grip portion of the at least one second protrusion of the second attachment support.

14. The support and attachment system of claim 1, wherein the second attachment support comprises the stop protrusion adapted to be in contact with a side surface of the second goggle strap connector to block rearward sliding movement of the goggles over the outside surface of the helmet.

15. The support and attachment system of claim 14, wherein the stop protrusion comprises at least one top portion and one blocking portion.

16. The support and attachment system of claim 15, wherein the top portion of the stop protrusion has a dimension greater than the dimension of the blocking portion to reinforce the blocking of the rearward sliding movement of goggles.

17. A method for attaching goggles to an helmet, the method comprising:

attaching a first attachment support to a side of the helmet;

attaching a second attachment support to the other side of the helmet;

engaging a second goggle strap connector with a second protrusion of the second attachment support;

engaging a side of the second goggle strap connector inside a stop protrusion of the second attachment support in a way to block the rearward rotation of the second goggle strap connector and the rearward sliding movement of the goggles over the outside surface of the helmet; and engaging a first goggle strap connector with a first protrusion of the first attachment support.

* * * * *